United States Patent [19]

Najjar et al.

[11] Patent Number: 4,732,700

[45] Date of Patent: Mar. 22, 1988

[54] PARTIAL OXIDATION OF VANADIUM-CONTAINING HEAVY LIQUID HYDROCARBONACEOUS AND SOLID CARBONACEOUS FUELS

[75] Inventors: Mitri S. Najjar, Hopewell Junction, N.Y.; Michael W. Becker, Los Alamitos; John S. Stevenson, Gardena, both of Calif.

[73] Assignee: Texaco Inc., White Plains, N.Y.

[21] Appl. No.: 923,375

[22] Filed: Oct. 27, 1986

[51] Int. Cl.[4] ..... C10J 3/46

[52] U.S. Cl. ..... 252/373

[58] Field of Search ..... 252/373; 48/197 R, 215

[56] References Cited

U.S. PATENT DOCUMENTS

| | | | |
|---|---|---|---|
| 4,436,530 | 3/1984 | Child et al. | 252/373 |
| 4,466,808 | 8/1984 | Koog | 252/373 |
| 4,474,584 | 8/1984 | Koog | 252/373 |
| 4,533,363 | 8/1985 | Jahnke et al. | 252/373 |
| 4,547,203 | 10/1985 | Jahnke | 252/373 |
| 4,654,164 | 3/1987 | Najjar | 252/373 |
| 4,668,428 | 5/1987 | Najjar | 252/373 |
| 4,668,429 | 5/1987 | Najjar | 252/373 |

FOREIGN PATENT DOCUMENTS

| | | | |
|---|---|---|---|
| 224313 | 8/1958 | Australia | 252/373 |
| 1341242 | 12/1973 | United Kingdom | 252/373 |
| 2086931 | 5/1982 | United Kingdom | 252/373 |
| 2099844 | 12/1982 | United Kingdom | 252/373 |

*Primary Examiner*—Michael L. Shippen
*Assistant Examiner*—Bruce D. Gray
*Attorney, Agent, or Firm*—Robert A. Kulason; James J. O'Loughlin; Albert Brent

[57] ABSTRACT

Process for the production of gaseous mixtures comprising $H_2+CO$ e.g. synthesis gas, reducing gas, or fuel gas by the partial oxidation of a vanadium-containing liquid hydrocarbonaceous fuel, solid carbonaceous fuel, or mixtures thereof in a free-flow vertical refractory lined gas generator. The feed mixture to the gas generator comprises (i) a vanadium-containing fuel; (ii) supplemental copper-containing additive; and (iii) at least a portion of the remainder of the copper-containing slag after separation of an enriched vanadium-containing coarse slag fraction. Materials (ii) and (iii) combine in the partial oxidation reaction zone with at least a portion of the nickel and iron constituents and the sulfur found in the feedstock to produce a liquid phase washing agent that collect and transports at least a portion of the vanadium-containing oxide laths and spinels and other ash components out of the reaction zone as molten vanadium-containing slag. A coarse slag fraction having a decreased Cu/V weight ratio is produced when a portion of the molten slag entrained in the hot raw effluent gas stream from the partial oxidation reaction zone is deposited on the walls of a slag separation chamber located between the bottom discharge outlet in the reaction zone and the effluent gas quench tank located at the bottom of the gas generator. Chunks of the slag drop into the quench tank and the enriched vanadium containing coarse slag portion is separated from the remainder of the copper-containing slag comprising smaller sized particles. It is economically advantageous to recover by-product vanadium from the coarse slag fraction in a metal refining plant.

56 Claims, No Drawings

PARTIAL OXIDATION OF VANADIUM-CONTAINING HEAVY LIQUID HYDROCARBONACEOUS AND SOLID CARBONACEOUS FUELS

FIELD OF THE INVENTION

This invention relates to the partial oxidation of vanadium-containing liquid hydrocarbonaceous fuel, solid carbonaceous fuel and mixtures thereof. More particularly, it pertains to the partial oxidation of vanadium-containing heavy liquid hydrocarbonaceous fuel including petroleum derived liquid fuels; vanadium-containing solid carbonaceous fuel, e.g., petroleum coke, asphalt, tarsands, shale, and mixtures thereof, to produce gaseous mixtures comprising $H_2+CO$.

Liquid hydrocarbonaceous fuels such as petroleum products and slurries of solid carbonaceous fuels such as petroleum coke and shale are well known fuels for the partial oxidation process. Because of their comparatively low cost, it is desirable to use these materials as feedstock to the partial oxidation process, such as described in coassigned U.S. Pat. No. 3,607,157, which is incorporated herein by reference. However, the widespread use of these materials in the partial oxidation process may be encumbered by the contaminates which they may contain. For example, vanadium may be present in the ash of these materials in a minimum amount of 5.0 wt. %. The presence of vanadium compounds in the slag requires the gasifier to be run at a higher temperature. By this means the molten slag produced in the gasifier would have a suitable fluidity for easy discharge. However, it is more costly to operate a gasifier at higher reaction temperatures. Further, the life of the gasifier is reduced. By the subject process the gas generator may be operated at a lower temperature, and vanadium may be recovered as a useful and profitable by-product.

SUMMARY OF THE INVENTION

In accordance with certain aspects of the invention there is provided a partial oxidation process for the production of gaseous mixtures comprising $H_2+CO$ in the reaction zone of a downflowing gas generator, the improvement comprising:

(1) mixing together the following materials to produce a feed mixture (i) a vanadium - containing fuel selected from the group consisting of liquid hydrocarbonaceous fuel, a slurry of solid carbonaceous fuel, and mixtures thereof; (ii) supplemental copper-containing additive; and (iii) at least a portion of the remainder of the copper-containing slag after separation of the coarse slag fraction in (5);

(2) reacting by partial oxidation in a refractory-lined free-flow unpacked reaction zone of said gas generator the vanadium-containing feed mixture from (1) to produce a hot raw effluent gas stream comprising $H_2+CO$ along with vanadium-containing molten slag comprising a liquid phase washing agent that collects and transports vanadium-containing laths and spinels and other ash components and refractory out of the reaction zone;

(3) passing the hot raw effluent gas stream from (2) down through a coaxial discharge passage in the bottom of the reaction zone of said gas generator and then into a connecting slag separation chamber that is provided with a bottom outlet; depositing a portion of the slag entrained in said hot raw gas stream on the walls of said separation chamber and building up the thickness of said slag on the walls of said chamber until chunks of slag having a diameter in the range of about ¼ inch to 10.0 inches and a Cu/V weight ratio which is less than that of the feed mixture in (1) separate from the wall and fall into quench water contained in a quench tank located below the bottom outlet in said separation chamber;

(4) passing through said quench tank at least a portion of the hot raw effluent gas stream leaving said slag separation chamber to produce said gaseous mixture comprising $H_2+CO$, and solidifying molten slag and separating out in said quench tank slag and particulate matter that were entrained in said hot raw gas stream; and (5) passing the water and solids from the bottom of said quench tank into a water-solids separation zone, removing a portion of the water and recycling said water to the quench tank; and separating a coarse slag fraction from the remainder of the slag; wherein said coarse slag fraction has a Cu/V weight ratio which is less than that of the feed mixture in (1).

In another embodiment pertaining to the gasification of petroleum coke with an copper-containing ash-fusion temperature reducing additive; the petroleum coke is produced by coking a mixture of vanadium-containing liquid hydrocarbonaceous fuel, supplemental copper-containing additive and a recycle copper-containing coarse slag fraction. This petroleum coke, with the additive and recycle slag fraction uniformly dispersed throughout, is then reacted in the partial oxidation gas generator with a free-oxygen containing gas and in the presence of a temperature moderator to produce synthesis gas, reducing gas, or fuel gas.

By the subject process, the vanadium content of the recycled copper-containing ash fraction is substantially reduced. This recycle ash fraction is capable of picking up more vanadium upon being recycled and passed through the gasifier where the carbon values in the slag may be converted into more synthesis gas. Further, the amount of supplemental ash fusion temperature reducing agent is reduced. Savings in the cost of the additive and in disposal costs of slag are thereby effected. Further, the vanadium may be recovered as a valuable by-product.

DISCLOSURE OF THE INVENTION

The subject invention pertains to the use of vanadium-containing petroleum-based heavy liquid hydrocarbonaceous fuels, solid carbonaceous fuels and mixtures thereof, as feedstock to a free-flow partial oxidation gas generator. Synthesis gas, reducing gas and fuel gas may be produced using these comparatively low-cost fuels.

The partial oxidation of heavy liquid hydrocarbonaceous fuel and petroleum coke are described respectively in coassigned U.S. Pat. Nos. 4,411,670 and 3,607,156, which are incorporated herein by reference. Suitable free-flow refractory lined gas generators and burners that may be used in the production of synthesis gas, reducing gas, or fuel gas from these materials, are also described in the aforesaid references. Advantageously, the subject process uses relatively inexpensive feedstocks comprising petroleum-based heavy liquid hydrocarbonaceous fuel and/or petroleum coke feedstocks having vanadium-containing ashes. Further, said feedstocks include a minimum of 0.5 wt. % of sulfur, such as at least 2.0 wt. % sulfur: and, said ash includes a minimum of 2.0 wt. % of vanadium, such as about 7.0 to 35 wt. % and a minimum of 2.0 wt. % of nickel, such as about 7.0 to 35 wt. %. Up to about 5000 parts per million (ppm) or higher of silicon, such as about 50 to 300 ppm, say about 450 to 1000 ppm are also present in the feed, and a minimum of 0.5 ppm of iron.

By definition, vanadium-containing heavy liquid hydrocarbonaceous material or fuel is a petroleum derived fuel, selected from the group consisting of virgin crude, residua from petroleum distillation and cracking, petroleum distillate, reduced crude, whole crude, asphalt, shale oil, tar sand oil and mixtures thereof. Heavy liquid hydrocarbonaceous fuels with vanadium-containing ash include high boiling liquid petroleum feed to or the bottoms from a vacuum tower or a fractionator. By definition, the term vanadium-containing petroleum coke is petroleum coke, made from the previously described ash-containing vanadium-containing heavy liquid hydrocarbonaceous fuel by conventional coking methods, such as by the delayed or fluid coking process such as described in coassigned U.S. Pat. No. 3,673,080 which is incorporated herein by reference.

Closer study of the ashes derived from the partial oxidation, without an additive, of a feedstock comprising heavy liquid hydrocarbonaceous fuels and/or petroleum coke having vanadium-containing ashes, shows that they are largely composed of oxide and sulfide compounds of vanadium, nickel, iron, along with some normally occurring mineral matter species. Vanadium-containing oxide laths are presently selected from the group consisting of V, V+Ca, V+Fe, V+Al, and mixtures thereof. Vanadium-containing spinels are present of the spinel-type aluminate phases with any metals selected from the group consisting of V, Cu, Cr, Al, Mg and mixtures thereof. The presence of abundant interlocking needle to lath-like crystals is the cause of the high viscosity of the slag.

The metals present in the ash provide a system that is significantly different from that occurring in coal. A further factor is that the total ash content of the petroleum coke or heavy liquid hydrocarbonaceous fuel may be only about 0.3 to 5 wt. %, whereas coal typically contains 10 to 20 wt. % ash. The comparatively low ash concentration in petroleum coke and heavy liquid carbonaceous fuel may be the reason why the ash removal problem is only noticed after prolonged gasifier runs. The likelihood for effective ash and additive mixing, that is necessary to wash the vanadium constituents out of the reaction zone or for effective fluxing is, therefore, greatly reduced.

It is theorized that, in the heavy liquid hydrocarbonaceous material and petroleum coke systems, a good deal of the ash material is liberated as individual molecular species. This is because, upon vacuum distillation or coking, the metallic species in the crude which are generally presented as porphyrin type structures (metal atoms, oxides or ions thereof confined in an organic framework), are entrapped within the collapsed carbon matrix.

Problems arise when the heavy metal constituents build up in the system. In particular, vanadium is known to accumulate on the walls of the refractory lined reaction zone of the partial oxidation gas generator and not flow smoothly from the gasifier under normal gasifier conditions. During shutdown and subsequent exposure of the gasifier walls to air, these deposits involving vanadium can catch fire, with the vanadium converting to the lower melting $V_2O_5$ or metal vanadate states. These materials prove to be very corrosive to refractory lining of the reaction zone. These problems, and others, are minimized by the subject process in which the amount of vanadium constituents in the reaction zone are substantially reduced.

In the process, a feed mixture is introduced into a free-flow unobstructed partial oxidation gas generator along with a free-oxygen containing gas and a temperature moderator. The feed mixture comprising (i) vanadium-containing liquid hydrocarbonaceous fuel, solid carbonaceous fuel, or mixtures thereof, (ii) supplemental copper-containing additive, and (iii) a recycle portion of the slag produced in the gas generator and upgraded by removing therefrom a coarse fraction rich in vanadium. The Cu/V weight ratio of the coarse slag fraction is about 40% to 70% less than that of said feed mixture. The amount of supplemental copper-containing additive make-up plus the recycle copper-containing slag is such as to provide the feed mixture with a Cu/V weight ratio in the range of about 5 to 75. The amount of copper in this feed mixture will assure the removal from the gas generator of sufficient vanadium so that the life of the refractory lining is extended, the slag flows freely from the gasifier, and the temperature in the reaction zone may be reduced.

The aforesaid ingredients (i), (ii), and (iii) of the feed mixture are preferably ground together in a conventional ball or rod mill. Alternatively, the ingredients may be ground separately or in pairs, and then mixed together. Preferably, the feed mixture has the following particle size distribution:

| U.S.A. Standard Series Sieve Designation Alternative - (ASTM E11) | Microns | Percent Passing |
|---|---|---|
| 14 | 1400 | 99.9 |
| 40 | 425 | 99.5 |
| 200 | 75 | 65 |
| 325 | 45 | 45–55 |

The partial oxidation reaction takes place at a temperature in the range of about 1900° F. to 2900° F., such as about 2200° F. to 2800° F. and a pressure in the range of about 1 to 300 atmospheres, such as about 5 to 250 atmospheres in a free-flow refractory lined partial oxidation reaction zone with a free-oxygen containing gas in the presence of a temperature moderator and in a reducing atmosphere to produce a hot raw effluent gas stream comprising $H_2+CO$ and vanadium-containing molten slag comprising a liquid phase washing agent that collects and transports the vanadium-containing laths and spinels and other ash components and refractory out of the reaction zone. In the partial oxidation reaction zone said copper-containing additive with the recycle portion of the slag produced in the gas generator and upgraded by removing therefrom a coarse fraction rich in vanadium combines with at least a portion of the nickel and iron constituents and sulfur in the feedstock (e.g. about 40 to 100 wt. % say about 70 to 90 wt. %) to generate said liquid phase washing agent that collects and transports at least a portion of the vanadium-containing oxide laths and spinels and other ash components and refractory out of the reaction zone as molten slag. The atoms of free-oxygen plus atoms of organically combined oxygen in the fuel per atom of carbon in the fuel (O/C atomic ratio) may be in the range of about 0.5 to 1.95, such as about 0.8 to 1.3.

The term free-oxygen containing gas, as used herein, is intended to include air, oxygen-enriched air, i.e. greater than 21 mole % oxygen, and substantially pure oxygen i.e. greater than 95 mole % oxygen (the remainder comprising $N_2$ and rare gases).

The term temperature moderator as employed herein includes water, steam, $CO_2$, $N_2$, and a recycle portion of the cooled product gas stream. For example, the weight ratio of $H_2O$/fuel may be in the range of about 0.1 to 3.

The supplemental copper-containing additive comprises copper and/or a copper compound selected from the group consisting of oxides, sulfides, sulfates, carbonates, cyanides, nitrates and mixtures thereof. Inorganic and/or organic copper compounds may be included. In one embodiment of the invention, said supplemental copper-containing additive is a cuprous or cupric organic compound selected from the group consisting of naphthenates, oxalates, acetates, benzoates, oleates, tartrates and mixtures thereof. Optionally, included in the copper-containing additive is an additional material selected from the group of elements consisting of iron, calcium, fluorine, manganese, magnesium, chromium, and mixtures thereof.

In still another embodiment, the supplemental copper-containing additive is a concentrated copper ore comprising about 20–30 weight % of copper. Copper ores with 1.0 wt. % copper or less are upgraded by concentrating e.g. crushing, grinding, flotation to produce concentrated copper ore minerals comprising sulfides and oxides containing about 20–30 wt. % of copper. For example, chalcopyrite concentrated copper ore is a mixture of the sulfides of copper, copper-iron and iron with smaller amounts of gangue minerals and normally contains 20–30% copper. The supplemental copper-containing additive may comprise copper minerals selected from the group of copper oxide minerals consisting of cuprite, tenorite, malachite, azurite, brochantite, atacamite, chrysocolla, and mixtures thereof. The weight of copper in the copper oxide minerals is in the range of about 35 to 89 wt. %. Further, the supplemental copper-containing additive may comprise copper minerals selected from the group of copper sulfide minerals consisting of bornite, chalcopyrite, tetrahedrite, tennantite, chalcocite, covellite, digenite and mixtures thereof. The weight % of copper in the copper sulfide minerals is in the range of about 34 to 80 weight %.

The raw product gas produced in the gasifier comprises mixtures of $H_2+CO$, along with other gaseous materials, e.g. $H_2O$, $CO_2$, $N_2$, $CH_4$, $H_2S$, COS, and entrained molten slag and particulate matter e.g. unconverted carbon. Depending on the relative amounts of $H_2$, CO and $CH_4$, the raw product gas stream may be called synthesis gas, reducing gas, or fuel gas. For example, synthesis gas has various $H_2$/CO mole ratios required for catalytic synthesis of organic chemicals. Reducing gas may be rich in $H_2$, and fuel gas contains $CH_4$ in admixture with the $H_2$ and CO.

The downflow gas generator is a vertical cylindrical shaped refractory lined pressure vessel free-from packing or catalyst. Coaxially aligned along the vertical central axis is an inlet port in the upper head. A burner for introducing and mixing together the feedstreams is mounted in this inlet port. The burner discharges into a refractory lined coaxial reaction zone which has a restricted bottom coaxial outlet or passage. The bottom outlet discharges into a coaxial refractory lined free-flow slag separation chamber. The volume of the slag separation chamber is substantially smaller than that of the reaction zone. The slag separation chamber may have a vertical cylindrical shape with coaxial inlet and outlet ports along the vertical longitudinal axis. The top of the slag separation chamber may be hemispherical or a diverging frusto-conical shaped dome. The slag separation chamber may have a converging hemispherical or converging frusto-conical bottom that discharges through a restricted orifice or passage and into a quench tank containing a pool of quench water in the bottom of the vessel. Alternatively, the slag separation chamber may be a refractory lined hollow sphere or hemisphere with coaxial vertical inlet and outlet ports.

The temperature of the hot raw effluent gas stream passing through the slag separation chamber and into the quench tank is in the range of about 1900° F. to 2900° F. such as about 2200° F. to 2800° F., while the temperature of the refractory walls of the slag separation chamber is lower e.g. in the range of about 1725° F. to 2500° F. The dwell time in the slag separation chamber is in the range of about 0.05 to 0.50 seconds. Further, from about 1.0 to 20.0 wt. % of the molten slag entrained in the hot raw gas stream separates out in the slag separation chamber. The remainder of the molten slag is carried into the quench water along with the hot raw effluent gas stream and solidifies. The slag builds up on the walls of the slag separation chamber until chunks having a diameter in the range of about ¼ inch to 10.0 inches separate from the wall by gravity with or without help from a jet of gas and falls into the quench water contained in the quench tank below. Suitable jets of gas may be selected from the group consisting of $N_2$, $CO_2$, $H_2O$, and recycle product gas. In the preferred embodiment, the slag separation chamber has a single outlet which is in the bottom of the slag separation vessel and which is coaxial with the vertical central axis. All of the hot raw effluent gas stream passes through this bottom outlet and passes into the quench vessel.

In another embodiment, the arrangement of the reaction zone, slag separation chamber, and quench tank is similar to that shown in coassigned U.S. Pat. Nos. 4,289,502 and 4,328,006, which are incorporated herein by reference.

In this embodiment, an outlet is provided in the side of the slag separation chamber for removing a portion e.g. about 1 to 99 volume % of the hot effluent gas stream, and cooling said portion of hot effluent gas in a gas cooler, such as in a waste heat boiler. The remainder of the hot effluent gas stream passes through the bottom outlet in the slag separation chamber. By this means the bottom outlet is kept hot. Slag is thereby prevented from freezing and plugging up the bottom outlet of the slag separation chamber.

One embodiment of the slag separation chamber comprises a plurality of coaxial hollow vertical cylinders of increasing diameter in tandem. In still another embodiment, the slag separation chamber is a hollow refractory lined vertical cylinder having a length to diameter ratio in the range of about 0.25 to 3.0 such as about 0.4 to 1.0; and the ratio of the diameter of the discharge passage in the bottom of the gas generator to the diameter of the slag separation chamber is in the range of about 0.3 to 0.8.

The hot effluent gas stream leaving the slag separation zone by way of the coaxial bottom outlet passes directly into the quench tank containing quench water. The quench tank is located at the bottom of the gas generator and may be part of the same pressure vessel;

or, it may be a separate vessel. Optionally, the hot gas stream may be introduced under the water level in the quench tank by means of a dip tube, as shown in coassigned U.S. Pat. No. 4,328,006. The cooled clean stream of $H_2+CO$ containing gas is removed by way of an outlet in the side of the quench tank above the water level.

The slag and particulate solids are separated from the water in the quench tank and a portion of the water is recycled to the quench tank in a water-solids separation zone. Thus, periodically, ash and solid particulate matter are removed from the bottom of the quench tank while maintaining the system pressure by means of a conventional lockhopper system such as that shown in coassigned U.S. Pat. Nos. 4,247,302 and 4,533,363 which are incorporated herein by reference. Optionally, prior to being introduced into the lockhopper system any larger pieces of slag in the aqueous slurry leaving the quench tank may be crushed to a maximum size of about 2"-3" by means of a conventional in-line slag crusher. For example, see coassigned U.S. Pat. No. 4,472,171, which is incorporated herein by reference.

In the water-solids separation zone selected from the group of equipment consisting of lockhopper, hydroclone, filter, clarifier, sieves, settler, and combinations thereof, ash is separated from the quench water. All of a coarse slag fraction as separated thereby, and which is comprised of all the slag particles of a size equal to or greater than that retained by ASTM E11 U.S.A. Standard Series Sieve Designation Alternative 1.5, has a Cu/V weight ratio in a range of about 35% to 70% less than that of the feed mixture to the partial oxidation gas generator. The coarse fraction comprises about 1 to 22 weight percent, such as about 2 to 13 wt. % of the total slag. American Society for Testing and Materials Standard E 11 (ASTM E11) is incorporated herein by reference.

Since the coarse slag fraction originated from slag that built up on the walls of the slag separation chamber, it is suggested that by some unknown mechanism, unexpectedly, vanadium in the feedstream is released and concentrated in the slag lining the walls of the slag separation chamber. It is economically attractive to recover by-product vanadium from this coarse slag fraction by conventional methods in a metals reclaiming process or facility. Further, it was unexpectedly found that the remaining slag fraction after separation of said coarse slag fraction by conventional means e.g. sieves has a particle size distribution which passes through ASTM E 11 U.S.A. Standard Series Sieve Designation Alternative No. 1.5 to No. 325, and below. Further, the remaining slag fraction has a Cu/V weight ratio in the range about equal to that of the feed mixture to the partial oxidation gas generator to 250% greater than that of said feed mixture. The increased Cu/V weight ratio for this fraction of slag is due to the removal of vanadium with the coarse slag fraction that originated on the walls of the slag separation chamber. It is economically attractive to dewater at least a portion of the vanadium-deficient remaining slag fraction after separating the coarse slag fraction and recycle it for mixing and/or grinding with fresh vanadium-containing fuel and supplemental copper-containing additive to produce the feed mixture to the partial oxidation gas generator. For example, in the feed mixture to the partial oxidation gas generator the weight ratio of the remaining slag fraction after separation of the coarse slag fraction to the sum of said remaining slag fraction and the supplemental copper-containing additive is in the range of about 0.25 to 0.90.

In another embodiment, the feed mixture comprises (i) vanadium-containing heavy liquid hydrocarbonaceous fuel, (ii) supplemental copper-containing additive, and (iii) copper-containing slag fraction as subsequently produced in the process comprising at least a portion of the remainder of the slag after separation of a coarse slag fraction whose Cu/V weight ratio is about 40% to 70% less than that of the subject feed mixture. This feed mixture at a temperature in the range of about 650° F. to 930° F. is introduced into a delayed coking zone where at a temperature in the range of about 800° F. to 895° F. and a pressure in the range of about 20 to 60 psig, uncondensed hydrocarbon effluent vapor and steam are removed overhead and petroleum coke having a vanadium-containing ash and having uniformly dispersed therein said copper-containing additive materials (ii) and (iii) is removed from the bottom.

Alternatively, the previously described feed mixture at a temperature in the range of about 550° F. to 750° F. is introduced into a fluidized bed coking zone where at a temperature in the range of about 1000° F. to 1200° F. and a pressure in the range of about 10 to 20 psig, uncondensed hydrocarbon effluent vapor and steam are removed overhead and petroleum coke having a vanadium-containing ash and having uniformly dispersed therein said copper-containing additive materials (ii) and (iii) is removed from the bottom.

The petroleum coke produced in the delayed or fluidized bed coking zones, as previously described has a Cu/V weight ratio in the range of about 5 to 75. The petroleum coke is introduced into a partial oxidation reaction zone as a pumpable slurry of petroleum coke in water, liquid hydrocarbonaceous fluid or mixtures thereof, or as substantially dry petroleum coke entrained in a gaseous transport medium, e.g. $H_2O$, $CO_2$, recycle product gas. The remaining steps in the partial oxidation process for the production of gaseous mixtures comprising $H_2+CO$ by the gasification of petroleum coke with copper-containing additive and recycle vanadium deficient copper-containing slag dispersed therein are substantially the same as described previously. The apparatus is also the same.

The coarse slag fraction which is separated from the remaining slag fraction for example by sieve in a slag sizing zone has a Cu/V weight ratio of about 40% to 70% less than that of the feed mixture to the coking zone, or the petroleum coke produced in the coking zone. The remainder of the copper-containing slag after the separation of the coarse slag fraction in slag sizing zone has a Cu/V weight ratio in a range about equal to that of the feed mixture to the coking zone or the petroleum coke produced to 250% greater than that of said feed mixture or the petroleum coke produced. Optically, by-product vanadium may be recovered from the course slag fraction in a separate metals reclaiming process or facility. This step is economically attractive. The sizes of the coarse slag fractions produced in both embodiments of the process are substantially the same. This also applies to the other slag fractions separated.

The following example illustrates a preferred embodiment of this invention. While a preferred mode of operation is illustrated, the Example should not be construed as limiting the scope of the invention.

EXAMPLE

An aqueous slurry feed to a partial oxidation gas generator comprises the following:

| | | wt. % |
|---|---|---|
| (i) | petroleum coke | 62.8 |
| (ii) | copper oxide-rich additive | 1.8 |
| (iii) | recycle upgraded copper-containing slag fraction after removal of coarse slag fraction | 2.4 |
| (iv) | water | 33.0 |

The solid composition of said aqueous slurry contains 1.17 wt. % Cu and 0.053 wt. % V, and has an Cu/V weight ratio of 22.08. Solid materials (i), (ii) and (iii) are simultaneously ground and slurried with water to produce a slurry with the following particle size distribution:

| U.S.A. Standard Series Sieve Designation Alternative - ASTM E11 | Microns | Percent Passing |
|---|---|---|
| No. 14 | 1400 | 99.9 |
| No. 40 | 425 | 99.5 |
| No. 200 | 75 | 65 |
| No. 325 | 45 | 45–55 |

The feed is subjected to partial oxidation in a refractory lined free-flow reaction zone at a temperature of about 2700° F. The gas-slag mixture exits from the bottom of the reaction zone through a 4 inch diameter throat 6 inches long. The gas-slag mixture then enters a vertical cylindrical shaped slag separation chamber 11 inches in diameter and 6 inches long. The thickness of the slag on the walls of the separation chamber is about 0.25 to 4 inches. The temperature of the walls of the separation chamber ranges from about 2400° F. near the top of the slag separation chamber to about 1900° F. near the bottom of the slag separation chamber. The dwell time in the slag separation chamber is 0.15 seconds. Pieces of slag drop by gravity through the 11 inches diameter outlet throat in the bottom of the separation chamber and into the quench water contained in the bottom of the quench tank located below the slag separation chamber. Further, all of the raw effluent gas stream passes through said outlet throat along with said slag.

The slag is recovered and screened. A coarse fraction of the slag comprising about 4 wt. % of the total slag is comprised of all of the slag particles of a size equal to or greater than that retained by ASTM E11 U.S.A. Standard Series Sieve Designation Alternative 1.5. The composition of the solids in the coarse slag fraction in weight percent comprises copper 31 and vanadium 5.4. The Cu/V weight ratio is 5.74. The remainder of the slag after separating the coarse slag fraction has a particle size distribution which passes through ASTM E11 U.S.A. Standard Series Sieve Designation Alternative No. 1.5 to No. 325 and below. The composition of the solids in this second slag fraction in weight percent comprises copper 38.0 and vanadium 0.927. The Cu/V weight ratio of this second slag fraction is 41. At least a portion of the second slag fraction is dewatered and recycled and ground with materials (i) and (ii) as previously described. At least a portion of the coarse slag fraction is sent to a metals refining plant to reclaim vanadium.

In another run, said second slag fraction is screened. About 30.0 wt. % of the total slag has a particle size distribution which passes through ASTM E11 U.S.A. Standard Series Sieve Designation Alternative No. 1.5 to No. 12. Unexpectedly, the composition of the solids in this third slag fraction in weight percent comprises copper 48.9 and vanadium 1.65. The Cu/V weight ratio is 29.6.

The aforesaid data clearly shows that unexpectedly, for the particle sizes of slag screened, the Cu/V weight ratio varies inversely with the particle size of the ash fraction. Further, in comparison with Cu/V wt. ratio of the aqueous slurry feed to the gas generator e.g. 22.08, the Cu/V wt. ratio of the coarse slag fraction is less e.g. 5.74, while that of the second and third fractions are respectively greater e.g. 38 and 29.6. By the subject process, vanadium may be concentrated in a coarse ash fraction. The coarse ash fraction may be then separated by screening from the remainder of the ash. The remainder of the ash may be recycled to the gas generator where it is mixed with fresh petroleum coke feed and supplemental copper oxide-rich additive. Optionally, the coarse ash fraction is sent to an external conventional metals reclaiming process or facility where by-product vanadium metal is recovered.

Various modifications of the invention as herein before set forth may be made without departing from the spirit and scope thereof, and therefore, only such limitations should be made as are indicated in the appended claims.

We claim:

1. In a partial oxidation process for the production of gaseous mixtures comprising $H_2+CO$ in the reaction zone of a down flowing gas generator, the improvement comprising:

(1) mixing together the following materials to produce a feed mixture (i) a vanadium-containing fuel whose ash includes a minimum of 2.0 weight % of vanadium selected from the group consisting of liquid hydrocarbonaceous fuel, a slurry of solid carbonaceous fuel, and mixtures thereof; (ii) supplemental copper-containing additive; and (iii) at least a portion of the remainder of the copper-containing slag after separation of the coarse slag fraction in (5);

(2) reacting by partial oxidation in a refractory-lined free-flow unpacked reaction zone of said gas generator the vanadium-containing feed mixture from (1) with a free-oxygen containing gas in the presence of a temperature moderator and in a reducing atmosphere to produce a hot raw effluent gas stream comprising $H_2+CO$ along with vanadium-containing molten slag comprising a liquid phase washing agent that collects and transports vanadium-containing laths and spinels and other ash components and refractory out of the reaction zone;

(3) passing the hot raw effluent gas stream from (2) down through a coaxial discharge passage in the bottom of the reaction zone of said gas generator and then into a connecting slag separation chamber that is provided with a bottom outlet; depositing a portion of the slag entrained in said hot raw gas stream on the walls of said separation chamber and building up the thickness of said slag on the walls of said chamber until chunks of slag having a diameter in the range of about ¼ inch to 10 inches and a Cu/V weight ratio which is less than that of the feed mixture in (1) separate from the wall and fall into quench water contained in a quench tank located below the bottom outlet in said separation chamber;

(4) passing through said quench tank at least a portion of the hot effluent gas stream leaving said slag separation chamber to produce said gaseous mixture comprising $H_2+CO$, and solidifying molten slag and separating out in said quench tank slag and particulate matter that were entrained in said hot raw gas stream; and (5) passing the water and solids from the bottom of said quench tank into a water-solids separation zone; removing a portion of the water from said vessel and recycling said water to the quench tank; and separating a coarse copper-containing slag fraction from the remainder of the slag and recycling said remainder of the slag to (1); wherein said coarse slag fraction has a Cu/V weight ratio which is less than that of the feed mixture in (1).

2. The process of claim 1 wherein the feed mixture in (1) has a Cu/V weight ratio in the range of about 5.0 to 75, and the coarse slag fraction separated in (5) has a Cu/V weight ratio of about 35% to 70% less than that of said feed mixture in (1).

3. The process of claim 1 wherein the remainder of the slag after separation of the coarse fraction in (5) has a Cu/V weight ratio in a range about equal to that of the feed mixture in (1) to 250% greater than that of the feed mixture in (1).

4. The process of claim 1 wherein all of the coarse slag fraction separated in (5) is comprised of all of the slag particles of a size equal to or greater than that retained by ASTM E11 U.S.A. Standard Series Sieve Designation Alternative 1.5.

5. The process of claim 1 wherein the feed mixture in (1) has the following particle size distribution:

| U.S.A. Standard Series Sieve Designation Alternative - ASTM E11 | Microns | Percent Passing |
|---|---|---|
| No. 14 | 1,400 | 99.9 |
| No. 40 | 425 | 99.5 |
| No. 200 | 75 | 65 |
| No. 325 | 45 | 45-55 |

6. The process of claim 1 wherein the slag separation chamber in (3) has the shape of a hollow sphere, hemisphere, or vertical cylinder with coaxial inlet and outlet ports along the vertical axis.

7. The process of claim 1 wherein the slag separation chamber in (3) comprises a plurality of coaxial hollow vertical cylinders in tandem.

8. The process of claim 1 wherein the slag separation chamber in (3) is a hollow refractory lined vertical cylinder, having a length to diameter ratio in the range of about 0.25 to 3.0, such as 0.4 to 1.0 and the ratio of the diameter of the discharge passage in the bottom of the gas generator to the diameter of the slag separation chamber is in the range of about 0.3 to 0.8.

9. The process of claim 1 wherein the dwell time of the hot raw effluent gas stream in said slag separation chamber is in the range of about 0.05 to 0.50 seconds.

10. The process of claim 1 wherein the feed materials (i), (ii), and (iii) are ground together to produce said feed mixture.

11. The process of claim 1 where in the slag separation chamber in (3) from about 1.0 to 25 wt. % of the molten slag entrained in said hot raw gas stream separates out.

12. The process of claim 1 wherein the temperature of the raw effluent gas stream passing through the slag separation chamber in (3) is in the range of about 1900° F. to 2900° F.

13. The process of claim 1 wherein the temperature of the refractory walls of the slag separation chamber in (3) is in the range of about 1725° F. to 2500° F.

14. The process of claim 1 wherein slag on the walls of the slag separation chamber in (3) separates from the wall by gravity with or without help from a jet of gas.

15. The process of claim 1 wherein the water-solids separation zone in (5) is selected from the group of equipment consisting of lockhopper, hydroclone, filter, clarifier, sieves, settler, and combinations thereof.

16. The process of claim 1 provided with the steps of dewatering at least a portion of the remainder of the slag after separation of the coarse slag fraction in (5), and grinding said portion with supplemental copper-containing additive and fresh vanadium-containing fuel to produce the feed mixture in (1).

17. The process of claim 1 provided with the step of recovering vanadium from said coarse slag fraction separated in (5) in a metals reclaiming zone.

18. The process of claim 1 wherein said supplemental copper-containing additive comprises copper and/or a copper compound selected from the group consisting of oxides, sulfides sulfates, carbonates, cyanides, nitrates and mixtures thereof.

19. The process of claim 1 wherein said supplemental copper-containing additive is a cuprous or cupric organic compound selected from the group consisting of naphthenates, oxalates, acetates, benzoates, oleates, tartrates and mixtures thereof.

20. The process of claim 1 where included in the supplemental copper-containing additive in (1) is an additional material selected from the group of elements consisting of iron, calcium, fluorine, magnesium, chromium and mixtures thereof.

21. The process of claim 1 wherein said supplemental copper-containing additive in (1) comprises an inorganic or organic compound of copper.

22. The process of claim 1 wherein said supplemental copper-containing additive in (1) comprises concentrated copper ore comprising at least 20 weight % of copper.

23. The process of claim 22 wherein said concentrated copper ore is a mixture of the sulfides of copper, copper-iron and iron with a small amount of gangue minerals.

24. The process of claim 1 wherein said supplemental copper-containing additive comprises copper sulfide and/or copper oxide minerals.

25. The process of claim 1 wherein said supplemental copper-containing additive comprises copper sulfide minerals selected from the group consisting of bornite, chalcopyrite, tetrahedrite, tennentite, chalcocite, covellite, digenite, and mixtures thereof.

26. The process of claim 1 wherein said supplemental copper-containing additive comprises copper oxide minerals selected from the group consisting of cuprite, tenorite, malachite, azurite, brochantite, atacamite, chrysocolla, and mixtures thereof.

27. The process of claim 1 wherein the weight ratio of material (1) (iii) to materials (1) (ii)+(1) (iii) is in the range of about 0.25 to 0.9.

28. The process of claim 1 provided with the step of reducing the size of the solids from the bottom of the quench tank to a maximum of about 2 inches to 3 inches.

29. The process of claim 1 wherein the slag separation chamber in (3) is provided with a side outlet in addition to said bottom outlet, and the hot raw effluent gas stream is divided between said bottom and side outlets.

30. The process of claim 1 with the step of removing a portion of the hot effluent gas stream from the slag separation chamber in (3) by way of an outlet in the side of said slag separation chamber, and cooling said portion of hot effluent gas in a gas cooler.

31. The process of claim 1 wherein said vanadium-containing liquid hydrocarbonaceous fuel is a petroleum derived liquid fuel selected from the group consisting of whole crude, residua from petroleum distillation and cracking, petroleum distillate, reduced crude, asphalt, shale oil, tar sand oil, and mixtures thereof.

32. The process of claim 1 wherein said vanadium-containing solid carbonaceous fuel is selected from the group consisting of petroleum coke, asphalt, tar sands, shale, and mixtures thereof.

33. A partial oxidation process for the production of gaseous mixtures comprising $H_2+CO$ in a vertical free-flow down flowing gas generator said process comprising:

(1) mixing together (i) a vanadium-containing heavy liquid hydrocarbonaceous fuel whose ash includes a minimum of 2.0 weight % of vanadium, (ii) supplemental copper-containing additive, and (iii) at least a portion of the remainder of the copper-containing slag fraction after separation of the coarse slag fraction in (7);

(2) coking said mixture from (1) to produce petroleum coke having vanadium-containing ash and having dispersed therein said materials (1) (ii) and (1) (iii); wherein the Cu/V weight ratio of said petroleum coke is in the range of about 5.0 to 75;

(3) introducing the petroleum coke from (2) into the partial oxidation reaction zone in (4) as a pumpable slurry of petroleum coke in water, liquid hydrocarbonaceous fluid or mixtures thereof, or as substantially dry petroleum coke entrained in a gaseous transport medium.

(4) reacting said petroleum coke from (3) at a temperature in the range of 1900° F. to 2900° F. and a pressure in the range of about 5 to 250 atmospheres in a free-flow refractory lined partial oxidation reaction zone of a gas generator with a free-oxygen containing gas in the presence of a temperature moderator and in a reducing atmosphere to produce a hot raw effluent gas stream comprising $H_2+CO$ and entrained vanadium-containing molten slag comprising a liquid phase washing agent that collects and transports vanadium-containing laths and spinels and other ash components and refractory out of the reaction zone; and particulate matter;

(5) passing the hot raw effluent gas stream from (4) down into a slag separation chamber, depositing a portion of the slag entrained in said hot raw gas stream on the walls of said slag separation chamber and building up the thickness of the said slag on the walls of said chamber until chunks of slag having a diameter in the range of about ¼ inch to 10 inches and a Cu/V weight ratio of 40% to 70% less than the Cu/V weight ratio of the petroleum coke produced in (2) separate from the wall and fall into quench water contained in a quench tank located below said slag separation chamber;

(6) passing through said quench tank at least a portion of the hot effluent gas stream leaving said slag separation chamber to produce said gaseous mixture comprising $H_2+CO$, and solidifying molten slag and separating out in said quench tank slag and particulate matter that were entrained in said hot raw gas stream; and (7) passing the water and solids from the bottom of said quench tank into a water-solids separation zone; removing a portion of the water and recycling said water to the quench tank; and separating a coarse slag fraction from the remainder of the slag and recycling said remainder of the slag to (1); wherein said coarse slag fraction has a Cu/V weight ratio which is less than that of the petroleum coke in (2).

34. The process of claim 33 where in (2) the mixture from (1) at a temperature in the range of about 650° F. to 930° F. is introduced into a delayed coking zone where at a temperature in the range of about 800° F. to 895° F. and a pressure in the range of about 20 to 60 psig, uncondensed hydrocarbon effluent vapor and steam are removed overhead and said petroleum coke having a nickel and vanadium-containing ash and having uniformly dispersed therein said copper-containing additive is removed from the bottom.

35. The process of claim 33 where in (2) the mixture from (1) at a temperature in the range of about 550° F. to 750° F. is introduced into a fluidized bed coking zone where at a temperature in the range of about 1000° F. to 1200° F. and a pressure in the range of about 10 to 20 psig, uncondensed hydrocarbon effluent vapor and steam are removed overhead and said petroleum coke is removed from the bottom.

36. The process of claim 33 where included in the supplemental copper-containing additive in (1) is an additional material selected from the group of elements consisting of iron, calcium, fluorine, magnesium, chromium and mixtures thereof.

37. The process of claim 33 wherein the feed mixture in (1) has a Cu/V weight ratio in the range of about 5.0 to 75, and the coarse slag fraction separated in (5) has a Cu/V weight ratio of about 40% to 70% less than that of said feed mixture in (1).

38. The process of claim 33 wherein the remainder of the copper-containing slag after separation of the coarse slag fraction in (7) has a Cu/V weight ratio in a range about equal to that of the feed mixture in (1) to 250% greater than that of the feed mixture in (1).

39. The process of claim 33 wherein the dwell time of the hot raw effluent gas stream in said slag separation chamber is in the range of about 0.05 to 0.50 seconds.

40. The process of claim 33 wherein the amount of slag that builds up on the walls of the slag separation chamber in (5) is from about 1.0 to 25 wt. % of the molten slag entrained in said hot raw gas stream.

41. The process of claim 33 wherein said supplemental copper-containing additive comprises a copper compound selected from the group consisting of oxides, sulfides, sulfates, carbonates, cyanides, nitrates, and mixtures thereof.

42. The process of claim 33 wherein said supplemental copper-containing additive is a cuprous or cupric organic compound selected from the group consisting of naphthenates, oxalates, acetates, benzoates, oleates, tartrates and mixtures thereof.

43. The process of claim 33 wherein said supplemental copper-containing additive in (1) comprises concentrated copper ore comprising at least 30 weight % of copper.

44. The process of claim 33 wherein said supplemental concentrated copper ore is a mixture of the sulfides of copper, copper-iron and iron with smaller amounts of gangue minerals.

45. The process of claim 33 wherein said supplemental copper-containing additive comprises copper sulfide and/or copper oxide minerals.

46. The process of claim 33 wherein said supplemental copper-containing additive comprises copper sulfide minerals selected from the group consisting of bornite, chalcopyrite, tetrahedrite, tennentite, chalcocite, covellite, and mixtures thereof.

47. The process of claim 33 wherein said supplemental copper-containing additive comprises copper oxide minerals selected from the group consisting of cuprite, tenorite, malachite, aqurite, brochantite, atacamite, chrysocolla, and mixtures thereof.

48. The process of claim 33 wherein the water-solids separation zone in (7) is selected from the group consisting of lockhopper, hydroclone, filter, clarifier, sieves, settler, and combinations thereof.

49. The process of claim 33 provided with the step of reducing the size of the solids from the bottom of the quench tank to a maximum of about 2 inches to 3 inches.

50. The process of claim 33 wherein the coarse slag fraction separated in (7) has a Cu/V weight ratio of about 40% to 70% less than that of said petroleum coke in (2).

51. The process of claim 33 wherein the remainder of the slag after separation of the coarse slag fraction in (7) has a Cu/V weight ratio in a range of about equal to that of the petroleum coke in (2) to 250% greater than that of the petroleum coke in (2).

52. The process of claim 33 wherein the coarse slag fraction separated in (7) is comprised of all of the slag particles of a size equal to or greater than that retained by ASTM E11 U.S.A. Standard Series Size Designation Alternative 1.5.

53. The process of claim 33 wherein the petroleum coke in (3) has the following particle size distribution:

| U.S.A. Standard Series Sieve Designation Alternative - ASTM E11 | Microns | Percent Passing |
|---|---|---|
| No. 14 | 1,400 | 99.9 |
| No. 40 | 425 | 99.5 |
| No. 200 | 75 | 65 |
| No. 325 | 45 | 45–55 |

54. The process of claim 33 with the step of removing a portion of the hot effluent gas stream from the slag separation chamber in (5) by way of an outlet in the side of said slag separation chamber, and cooling said portion of hot effluent gas in a gas cooler.

55. The process of claim 33 provided with the step of recovering vanadium from said coarse slag fraction in (7) in a metals reclaiming zone.

56. The process of claim 33 wherein said vanadium-containing liquid hydrocarbonaceous fuel is a petroleum derived liquid fuel selected from the group consisting of whole crude, residua from petroleum distillation and cracking, petroleum distillate, reduced crude, asphalt, shale oil, tar sand oil, and mixtures thereof.

* * * * *

UNITED STATES PATENT AND TRADEMARK OFFICE

CERTIFICATE OF CORRECTION

PATENT NO. : 4,732,700

DATED : March 22, 1988

INVENTOR(S) : M.S. Najjar, M.W. Becker, J. S. Stevenson

It is certified that error appears in the above—identified patent and that said Letters Patent is hereby corrected as shown below:

Column 13 Line 47 After "medium" change "." to —;—

Signed and Sealed this

Eighth Day of November, 1988

*Attest:*

*Attesting Officer*

DONALD J. QUIGG

*Commissioner of Patents and Trademarks*